US005446996A

United States Patent [19]

Lamont

[11] Patent Number: 5,446,996

[45] **Date of Patent: * Sep. 5, 1995**

[54] PORTABLE SECURITY GRILL APPARATUS

[76] Inventor: Tim Lamont, 4524 Albion Dr., Riverside, Calif. 92503

[ * ] Notice: The portion of the term of this patent subsequent to Feb. 8, 2011 has been disclaimed.

[21] Appl. No.: 192,377

[22] Filed: Feb. 7, 1994

Related U.S. Application Data

[63] Continuation-in-part of Ser. No. 912,727, Aug. 4, 1992, Pat. No. 5,283,976, which is a continuation of Ser. No. 729,222, Jul. 12, 1991, Pat. No. 5,131,186, which is a continuation-in-part of Ser. No. 372,839, Jun. 29, 1989, abandoned.

[51] Int. Cl.[6] ..... E06B 7/00

[52] U.S. Cl. ..... 49/57; 49/55; 49/465

[58] Field of Search ..... 49/50, 55, 56, 57, 463, 49/465, 124; 52/106, 202

[56] References Cited

U.S. PATENT DOCUMENTS

| | | | |
|---|---|---|---|
| 560,937 | 5/1896 | Ryan | 49/57 X |
| 2,594,864 | 4/1952 | Buckland et al. | 49/57 X |
| 2,756,469 | 7/1956 | Cattermole et al. | 49/55 |
| 3,163,205 | 12/1964 | Gottlieb | 49/55 X |
| 4,899,490 | 2/1990 | Jokel | 49/57 x |
| 5,131,186 | 7/1992 | La Mont | 49/57 |
| 5,283,976 | 2/1994 | La Mont | 49/55 |

FOREIGN PATENT DOCUMENTS

| | | | |
|---|---|---|---|
| 2114197 | 8/1983 | United Kingdom | 49/55 |
| 2198172 | 6/1988 | United Kingdom | 49/55 |
| 2214551 | 9/1989 | United Kingdom | 49/55 |

*Primary Examiner*—Jerry Redman
*Attorney, Agent, or Firm*—Plante & Strauss

[57] ABSTRACT

A portable security grill apparatus which may be installed in window openings of buildings includes two rectangular grill sections longitudinally telescopically fastened to one another. Opposite longitudinal ends of the two grill sections have beams disposed perpendicularly to the axis of longitudinal telescoping movability of the two grill sections, the beams having flat outer surfaces adapted to abut a window edge at one end of the grill apparatus, and a window frame edge, at the other end of the apparatus. At least one toggle clamp connected between telescopically joined members of the two grill sections is capable of exerting a large outward extension force when in a closed, clamped position, thereby exerting compressive forces on the window and window frame sufficient to prevent the grill apparatus from being removed from the window opening.

11 Claims, 4 Drawing Sheets

FIGURE 6
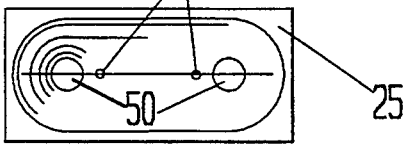
FIGURE 7
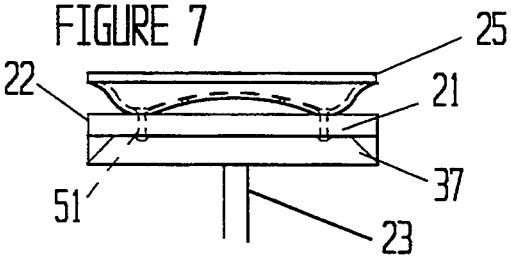
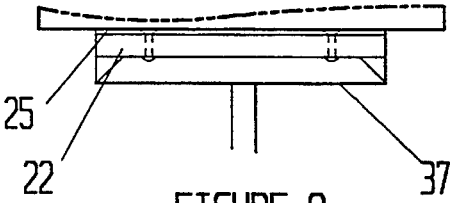
FIGURE 8
FIGURE 9
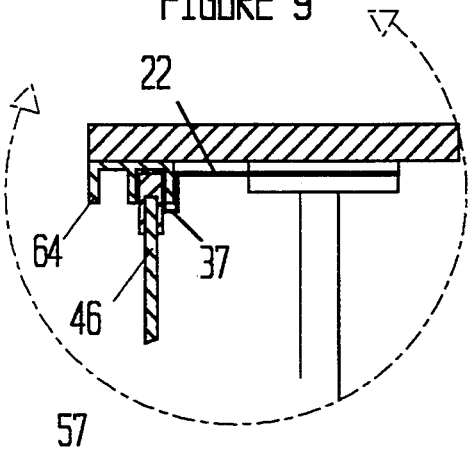
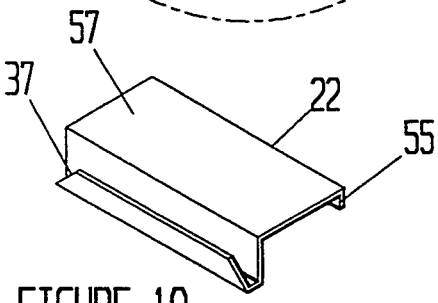
FIGURE 10

PORTABLE SECURITY GRILL APPARATUS

REFERENCE TO RELATED APPLICATIONS

This application is a continuation-in-part of my copending application Ser. No. 912,727, filed Aug. 4, 1992, now U.S. Pat. No. 5,283,976, which is a continuation of my application Ser. No. 729,222, filed Jul. 12, 1991, now U.S. Pat. No. 5,131,186, issued on Jul. 21, 1992, which is a continuation-in-part of my copending application Ser. No. 07/372,839, filed on Jun. 29, 1989, now abandoned.

BACKGROUND OF THE INVENTION

1. Field of the Invention

The present invention relates to apparatus for preventing unauthorized entry into buildings via window openings. More particularly, the invention relates to a portable apparatus which may be installed in a window opening to permit air and light to enter a building, while preventing persons from entering the building through the window opening.

2. Discussion of Background Art

It is an unfortunate fact that the crime rate in our country is on the increase. Thus, many individuals who because of their geographic location, away from high crime rate areas, or for other reasons, felt themselves immune from the crime problem, must now confront one manifestation of that problem; namely the ever-increasing rate of business and residential burglaries.

Most rational individuals would not wish the material fruits of their labors to be stolen from them by burglars. More importantly, most people are genuinely concerned that those criminals who would break into their dwelling places or residences to steal their possessions often are the type of individuals who would just as soon kill or injure the owner or his loved ones, should they be present during the course of a burglary.

As a result of their concern for the protection of their property, and the lives of themselves and their loved ones, a substantial percentage of the population have begun to take measures to protect themselves from burglars. For example, many homeowners and business owners have installed more secure door locks, and burglar alarms in their homes and shops. Another form of protection which has found increasing favor are security bar devices which, when installed over window openings or doorways, provide a very effective barrier to unauthorized entry through the protected opening. Such security bar devices generally take the form of a grill comprising a parallel array, or lattice array of heavy metal bars which are spaced closely enough to prevent passage through the array by a person.

Security bar devices of the type described above generally provide an effective means of preventing undesired entry to buildings through the protected areas. However, most such security bar devices suffer from one or more disadvantages which limit their wider usage. For example, many older security bar devices are not equipped with a safety mechanism which permits escape of the building occupants in the case of fire or other accidents within the building, or the entrance of firemen or other emergency personnel. Unfortunately, the absence of such a safety release provision in some security bar devices has resulted in the tragic loss of life.

Although there are now available security bar devices that are provided with safety release mechanisms, these as well as the older type security bar devices have an inherent feature which limits their more widespread usage. Specifically, most available security bar devices are relatively heavy and costly, and are intended for relatively permanent, and correspondingly costly, installation. Accordingly, such security bar devices are generally unsuitable for people who rent or have limited incomes. Some devices have been disclosed which would seem to address the problem of providing a security bar device which might be usable in non-permanent installation applications. Typical of such disclosures are those contained in the following U.S. patents:

Iyersen, U.S. Pat. No. 4,757,465, Mar. 18, 1986, Security Grill Apparatus for Doors and Windows.

Zilkha, U.S. Pat. No. 4,624,072, Nov. 25, 1986, Adjustable Security Window Gates.

Merklingen, et al., U.S. Pat. No. 4,671,012, Jun. 9, 1987, Security Barrier.

Jokel, U.S. Pat. No. 4,680,890, Jul. 21, 1987, Window Intrusion Barrier.

The present invention was conceived of to provide a security grill apparatus which is highly portable and useable in window openings of various dimensions.

OBJECTS OF THE INVENTION

An object of the present invention is to provide a portable security grill apparatus which may be readily installed in a window opening, while providing an effective bar to entrance by individuals through the window opening.

Another object of the invention is to provide a portable security grill apparatus for windows which is readily adjustable to fit within various height spaces between a window sill and the bottom of a raised window.

Another object of the invention is to provide a portable security grill apparatus for windows which may be quickly and securely clamped into a compressively locking contact between parallel structural members, such as the lower surface of a raised window and the upper surface of a window sill.

Another object of the invention is to provide a portable security grill apparatus for windows which may be optionally secured in locking position with a key lock, after being compressively locked into position.

Another object of the invention is to provide a portable security grill apparatus for window openings which may be quickly unlocked and removed from a window opening.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention, reasonably inferable from the description contained herein be included within the scope of the invention as defined by the appended claims.

SUMMARY OF THE INVENTION

Briefly stated, the present invention comprehends a portable security grill apparatus for removable installation in openings in the walls of structures such as shops, industrial buildings, and dwelling places such as homes and apartments. The apparatus according to the present invention is particularly well adapted to removable installation in window frames with the window slid to an open upper or side position. The apparatus prevents unauthorized entrance through the window opening, while allowing the window to be open for ventilation purposes, and allowing light to enter the room protected.

The portable security grill apparatus according to the present invention includes a grill comprising a plurality of regularly spaced horizontally disposed rigid metal bars, welded to a plurality of vertically disposed, hollow rigid metal bars. The lower ends of the vertical bars are fastened to a horizontally disposed, flat lower beam adapted to seat firmly against the upper surface of a window sill. The upper ends of the hollow vertical bars slidably contain a short bars. Each of the upper ends of the short bars is in turn attached to a horizontally disposed, flat plate adapted to seat firmly against the lower surface of an open window, or window frame. The lower beam and each of the upper plates support resilient pads which have concave depressions to form suction cups which grip the window frame surfaces. Also, window clamps extend coextensively along the outside edge of the lower beam and upper plates and seat over the inside flanges of the window tracks, thereby firmly interlocking the grill apparatus in place.

Toggle clamp mechanisms are connected between each short bar and the hollow bar in which it is positioned. When the toggle clamp mechanism is compressed into its closed position, the short bar is forced upwards with respect to the hollow bar to which it is joined by the toggle clamp mechanism. Thus, closing the toggle clamp forces a short bar to move telescopically upwards, moving its upper plate upwards.

Means are included within the toggle clamp mechanism to adjust the amount of upward travel of the short bar and its upper plate. Also, the toggle clamp mechanism is so constructed as to have a substantial mechanical force advantage. Therefore, a substantial compressive force may be exerted between the upper and lower window frame members when the toggle clamps are closed. That force is sufficiently large to preclude pulling the security bar apparatus from the window frame, without releasing the toggle clamp operating lever, and the resistance of the apparatus to dislodgement is enhanced by the resilient pads and window clamps which are secured to each of the lower beam and upper plates. Since the toggle clamp lever is located inside the structure protected, it is not accessible to an intruder. In the preferred embodiment of the apparatus, a key lock is attached to the toggle clamp, permitting release of the toggle clamp lever only by first inserting a key and turning the key lock to an unlocked position.

BRIEF DESCRIPTION OF THE DRAWINGS

FIG. 6 is a top view of the window frame clamp pad used with the security grill apparatus of this invention;

FIG. 7 is an elevational view of the window frame clamp pad shown in FIG. 6;

FIG. 8 is an elevational view of the clamp pad engaged against a window frame;

FIG. 9 is a enlarged view of the area within line 9—9′ of FIG. 3, showing the window clamp and clamp pad used in the invention; and FIG. 10 is a perspective view of a window clamp used with the invention.

DESCRIPTION OF THE PREFERRED EMBODIMENTS

Figure 1:
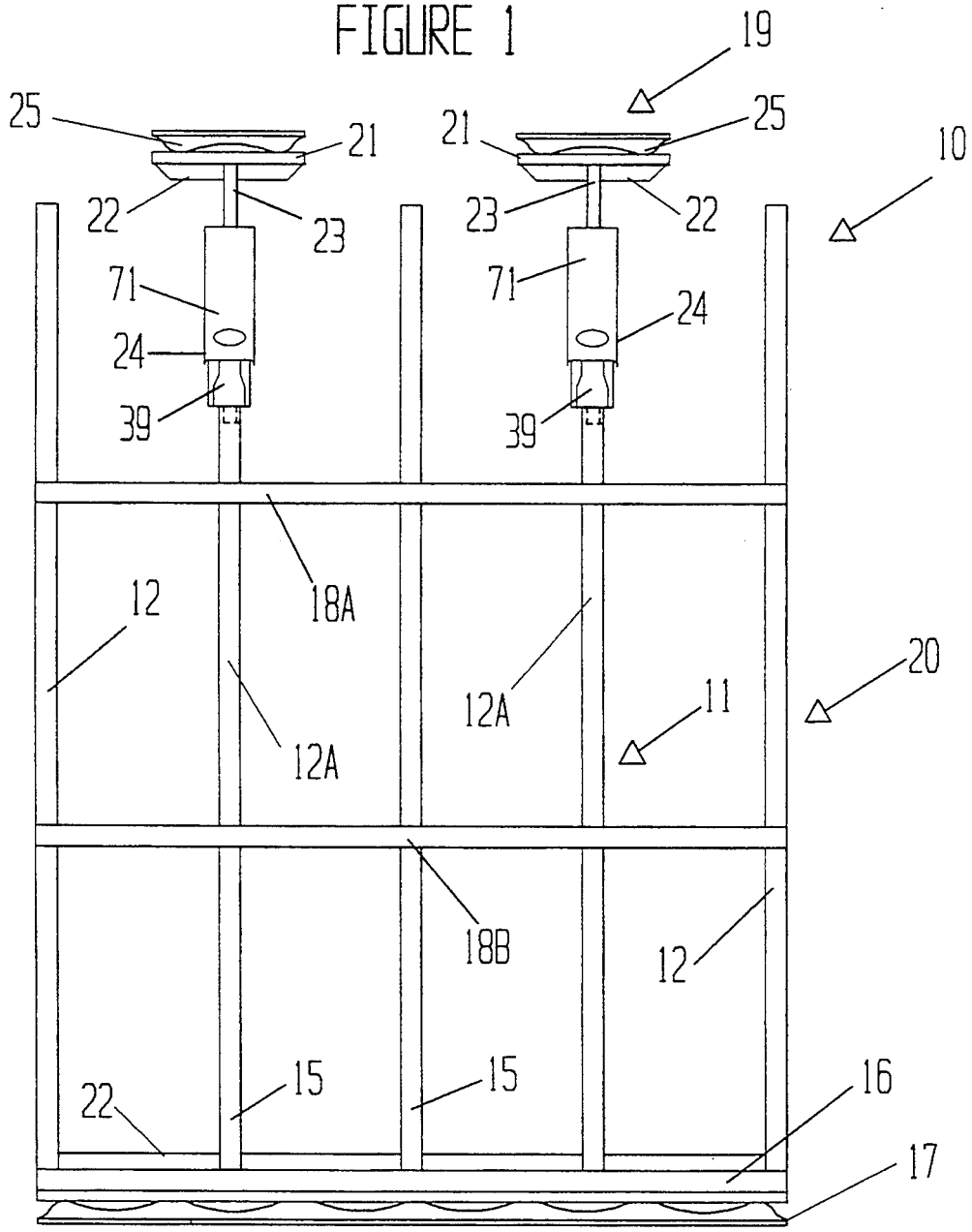
FIG. 1 is an inside elevation view of the security grill apparatus according to the present invention, showing the apparatus installed in a window opening.

Referring now to FIGS. 1 through 5, a portable security grill apparatus 10 is shown. As shown in FIG. 1, the apparatus 10 is vertically positioned for installation in a window frame with a horizontally slidable window. However, the apparatus may also be oriented for installation in a window frame having a vertically slidable window.

As shown in FIG. 1, the security grill apparatus includes a grill 11 having a plurality of elongated straight rigid metal bars 12. Bars 12 are arranged in vertically disposed parallel positions, at regular horizontal intervals, and all lie in a common plane.

Figure 2:
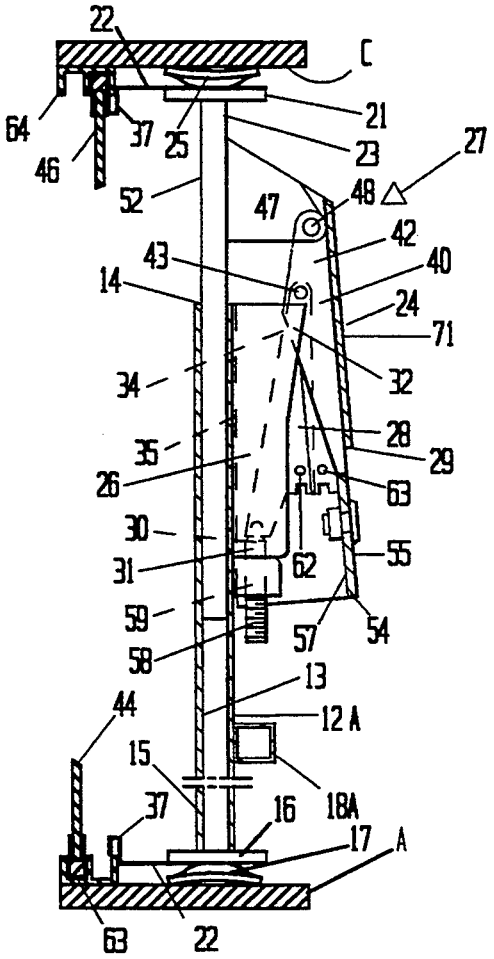
FIG. 2 is a fragmentary side elevation view of the apparatus of FIG. 1, on a somewhat enlarged scale, showing the apparatus in a retracted position.
Figure 3:
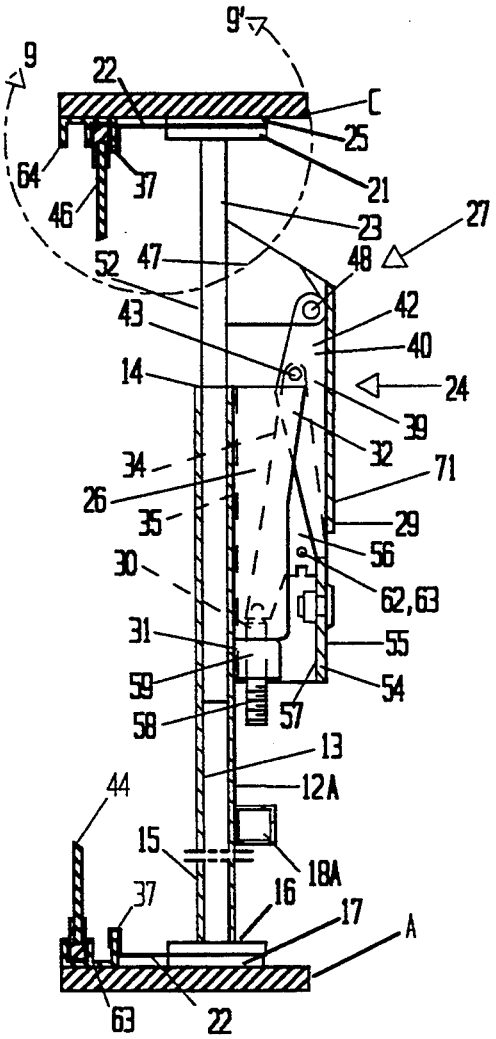
FIG. 3 is a view similar to FIG. 2, but showing the apparatus in an extended position.

As may be seen best by referring to FIGS. 1, 2 and 3, at least the upper end of each of the bars 12A contains a hollow coaxial bore 13 extending longitudinally inward some distance from the upper transverse face 14 of the bar 12A. Preferably, bars 12 and 12A are fabricated from square cross-section, hollow steel tubes. When so fabricated, bore 13 has a square cross-sectional shape, and extends through the entire length of a bar 12 or 12A.

The lower transverse ends 15 of bars 12 are welded or otherwise secured to a flat, elongated rectangular base plate 16 made of steel or other rigid material. The lower surface of base plate 16 supports an elongated rectangular pad 17 formed of an elastomer, preferably rubber, which is secured to plate 16 with a plurality of rivets (not shown) at spaced-apart locations. The rivets pull the pad 17 into a plurality of cup depressions (see FIG. 2) in the uncompressed state. The plate 17 also supports an elongated window clamp 22, described in greater detail with reference to FIGS. 2, 3, 9 and 10.

As may be seen best by referring to FIG. 1, grill 11 of security grill apparatus 10 includes a plurality of elongated, straight rigid metal cross bars such as upper bar 18A and lower bar 18B. Cross bars 18A and 18B are arranged in horizontally disposed parallel positions, at regular vertical intervals. The cross bars are welded to the front, or inner surface of vertical bars 12, thus forming therewith a rigid, planar grill structure. Cross bars 18A and 18B may be fabricated from the same type of steel tubing as vertical bars 12, if desired.

As may be seen best by referring to FIG. 1, grill 11 of security bar apparatus 10 includes at least a pair of upper clamps 19 which are spaced apart at locations which are preferably symmetrical across the apparatus 10. Each of the clamps 19 is vertically telescopable with respect to lower section 20 of the grill 11, in a manner which will now be described.

As shown in FIGS. 1, 2 and 3, each clamp 19 includes an upper elongated rectangular flat steel plate 21, which is substantially identical in thickness and width to base plate 16, and can be of a variable length. Each plate 21 supports a clamp pad 25 of the same rubber material as clamp pad 17 and which is secured to plate 21 by spaced-apart rivets, forming cup shaped depressions, as described for pad 17. Each base plate 21 supports a coextensive window clamp 22.

Each clamp 19 includes a straight, relative short metal bar 23, which is fastened to plate 21, and which extends perpendicularly downwards from the plate. The short metal bars 23 have smaller outer cross-sectional dimensions than the corresponding dimensions of the bores 13 in long vertical bars 12A and are telescopingly received therein, to permit the clamps 19 to move up and down vertically with respect to lower section 20 while maintaining the upper plates 21 in parallel alignment with the lower plate 16.

As shown in FIG. 1, a toggle clamp mechanism 24 is operatively interconnected between the upper portion of a hollow vertical tube 12A and a short vertical bar 23 which is telescopically slidably located within the bore 13 of the vertical bar 12A. Preferably, each security bar apparatus 10 includes two such toggle clamp mechanisms 24, spaced at equidistant intervals from the lateral sides of the grill 11.

The structure and operation of toggle clamp mechanism 24 may be best understood by referring to FIGS. 2, 3, 4 and 5. FIG. 2 illustrates the toggle clamp mechanism 24 in an open position, in which the short metal bars 23 are in a downward, retracted relationship relative to the lower vertical bars 12. In this position, the clamp pad 17 rests on the upper surface or sill A of a window frame and the upper clamp pads 25 are positioned below the lower surface C of the window frame.

The window is a conventional horizontal sliding window with an upper track 64 and a lower track 63 with one or two sliding glass panels 44 and 46.

As shown in FIGS. 2, 9 and 10, each of the plates 16 and 21 support coextensive window clamps 22, formed of sheet metal. Each clamp 22 has a flat web that projects to the inside edges of window tracks 64 and 63. The clamp 22 is bent into a channel 37 having a width sufficient to receive the inside flange of each track 64 and 63.

As shown in FIG. 10, the opposite ends of each channel 37 are chamfered, preferably at 45°, to prevent binding of the sliding window panels.

As shown in FIGS. 2, 3, 4 and 5, the toggle clamp mechanism 24 includes a channel frame section 26 which is fastened to an outer vertical surface of a lower rigid vertical bar 12A. The toggle clamp mechanism 24 also includes a multi-component lever mechanism 27 which is vertically slidably attached to the channel frame section 26, and pivotally attached to a short vertically disposed, metal upper bar 23, the latter being vertically slidable within the bore 13 of lower tubular bar 12A.

As shown in FIGS. 2, 3, 4 and 5, the lever mechanism 27 of toggle clamp mechanism 24 includes a base plate 28, an operating arm 39, and an engagement lug 30. The base plate 28 of lever mechanism 27 is vertically slidably supported within channel frame section 26, as will now be described.

Channel frame section 26 has a tubular lower end 31 of relatively short length, the major, upper portion of the channel frame section 26 having the shape of a vertically elongated, open U-shaped channel 32. The opposite upper edges of the side walls of channel 32 flare inwardly to form opposed laterally spaced-apart, longitudinally disposed parallel flanges 33 (see FIG. 5). Base plate 28 has a generally uniform thickness, and has in elevation view the approximate shape of a vertically elongated trapezoid. The inner vertical surface 34 of base plate 28 is flat and adapted to move slidably on the bottom surface 35 of channel 32 of channel frame section 26. Near the bottom end of base plate 28, are rounded bosses 36 (see FIG. 5) which project perpendicularly outward from the front and rear vertical surfaces 37 and 38, respectively, of base plate 28. The lateral distance between the outer surfaces of bosses 36 is greater than the distance between the inner facing wall surfaces of flanges 33 of channel frame section 26. Thus, base plate 28 is vertically slidable within channel 32 in channel frame section 26, but prevented from moving laterally out of the channel by contact of bosses 36 with flanges 33.

As shown in FIGS. 1 through 5, the lever mechanism 27 of toggle clamp mechanism 24 includes an outer lever arm 39. Lever arm 39 is an elongated member having an upper channel-shaped portion 40 having front and rear side walls 41 and 42 (see FIG. 5) formed therein. The lateral spacing between the inner surfaces of front and rear side walls 41 and 42 of upper channel section 40 of lever arm 39 is slightly larger than the thickness of base plate 28 of lever mechanism 27. This difference permits the upper end of base plate 28 to reside pivotally within channel section 40 of lever arm 39. The pivotal joint between base plate 28 and lever arm 39 consists of a pivot pin 43 which extends through registered holes and in the front and rear sidewalls 41 and 42, respectively, of upper channel section 40 of the lever arm. Pivot pin 43 is located about one-fifth of the longitudinal distance between the upper and lower ends of the lever arm 39.

The upper end of lever arm 39 is secured to a generally trapezoidal or triangular shaped lug 47 of generally uniform thickness, pivotally held between the front and rear walls 41 and 42 of the lever arm. The lug can be fixedly secured, by welding, to the short bar 23. The inner, smaller vertex or base of lug 47 is pivotally attached within the upper channel section 40 of lever arm 34 by means of a pivot pin 48 fastened in holes in the front and rear walls, and passing through a clearance hole through the lug.

The lower end of lever arm 39 has a generally flat plate-like handle section 54. Plate-like handle section 54 has a flat outer lateral surface 55. Plate-like handle section has a generally rectangular plan-view shape and is joined near its upper end to the lower ends of front and rear side walls 41 and 42 of upper channel section 40 of the lever arm 39, perpendicular thereto. A generally uniform-thickness locking tab 56 having a generally triangular-shaped plan-view is fastened to the inner wall surface of the lower end of front side wall 41 of upper channel section 40. Locking tab 56 lies in a vertical plane and extends perpendicularly inward from the inner wall surface 57 of plate-like lower handle section 54.

FIG. 3 illustrates the grill 10 in place and compressed within the window. The compression flattens the base clamp pad 17 and its cup-shaped depressions function as suction cups to enhance the resistance of the grill against dislodgement from the window. Similarly, the clamp pads 25 associated with each clamp 19 are flattened and secure against the under surface C of the window frame.

The channels 37 which extend coextensively with plates 16 and 21 are received over the inner flanges of window tracks 64 and 63 to interlock the grill to the window and prevent its dislodgement.

As may be seen best by referring to FIGS. 2 and 3, lever arm 39 may be pivoted in a vertical plane with respect to channel frame section 26 of toggle clamp mechanism 24, about intermediate pivot pin 43. As shown in FIG. 3, downward and inward pivotal motion of lever arm 39 relative to channel frame section 26 and attached lower tubular vertical bar 12 moves lug 47 upwards. This in turn moves upper vertical bar 23, which is engaged by lug 47 which is rigidly secured to the upper vertical bar 23, upwards with respect to the lower tubular 12. Thus, as shown in FIGS. 2 and 3, base plate 16 and roof plate 21 are spread apart vertically, allowing a compressive force to be exerted between window sill A and window top frame C. Owing to the fact that the ratio of the distance between the lower end of handle section 54 and intermediate pivot pin 43 on the one hand, and the distance between the intermediate pin 43 and upper pivot pin 48, on the other, is about 5 to 1, a substantial, locking compressive force may be exerted which requires only a modest closing force on handle section 54. This force can be sufficiently great to render the removal of the security bar apparatus 10 from a window frame a virtual impossibility unless the window and/or frame are destroyed.

As shown in FIGS. 2 through 5, a threaded stud 58 is contained in a threaded bore 59 in lower tubular end 31 of channel frame section 26. Stud 58 is an adjustable support for the lever mechanism, as the upper end 60 (see FIG. 5) of the threaded stud abuts the lower end 61 of base plate 28 of lever mechanism 27, thus permitting the lower limit of motion of the base plate to be adjusted to a desired value. Thus, turning threaded stud 58 permits adjusting the locked and unlocked vertical extension of security bar apparatus 10 to fit various size window openings.

As shown in FIG. 2, the lower end of base plate 28 and locking tab 56 are provided with through holes 62 and 63, respectively. Holes 62 and 63 are equal distances from intermediate pivot pin 43. Thus, with the toggle clamp mechanism 24 in a locked position, as shown in FIG. 3, holes 62 and 63 are in a registered position, permitting a locking member, such as the hasp of a conventional combination or key lock, to be inserted through the holes.

Figure 4:
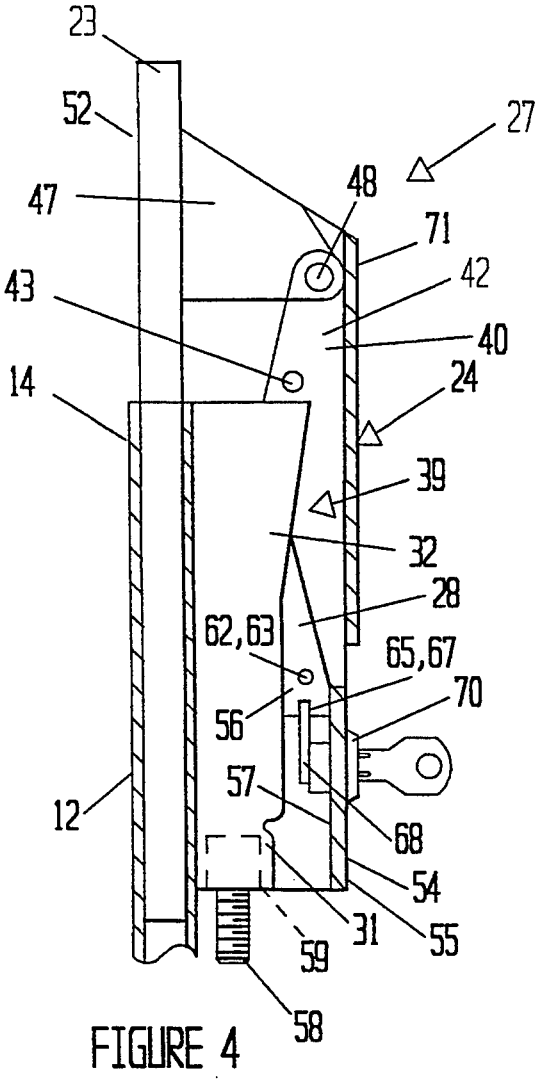
FIG. 4 is a fragmentary side elevation view of the apparatus of FIG. 1, showing the toggle clamp mechanism in a closed and locked position.
Figure 5:
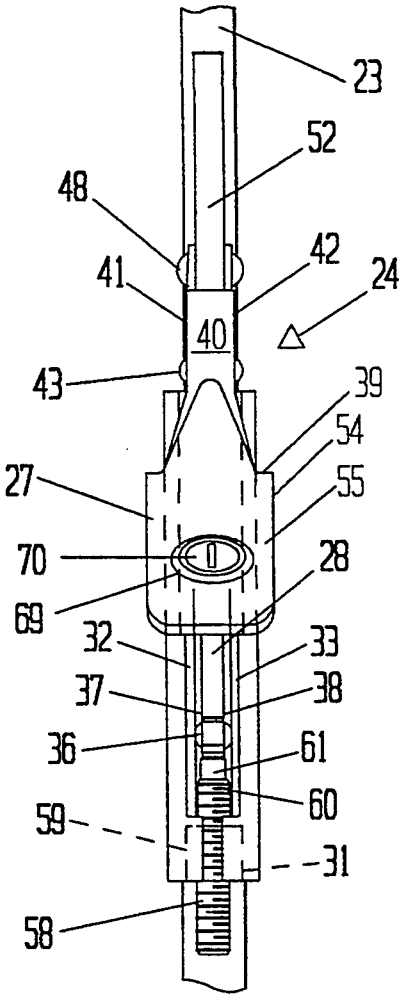
FIG. 5 is a fragmentary front elevation view of the apparatus of FIG. 4, showing the lever of a toggle clamp forming part of the apparatus pivoted into an upward position.

As may be seen best by referring to FIGS. 1 and 4, the upper portion of each toggle clamp mechanism 24 is preferably concealed by means of a U-channel-shaped cover 71 which is fastened to the outer wall of upper channel-shaped portion 40 of lever arm 39 by any convenient means.

Referring now to FIGS. 6 through 8, the construction and functioning of the resilient pads 25 and 17 will be described. As previously mentioned each pad is formed of an elastomer, preferably rubber, and is attached to its supporting plate 16 or 21 with a plurality of spaced-apart rivets 50. The rivets contort the surface of the rubber pads 25 and 17 and form a plurality of concave depressions, similar to suction cups in the uncompressed state, shown in FIGS. 6 and 7. When the pads are compressed, however, they flatten to the shape shown in FIGS. 8 and 9, creating a suction between the rubber pads and the opposing window frame surface. This suction greatly resists lateral displacement of the grill apparatus. Preferably, each concave depression in the pads 17 and 25 is provided with a through aperture 51 which releases the suction when the toggle clamp mechanism is opened, thereby permitting easy removal of the pads from the window surfaces. The apertures are sealed when the pads are flattened and compressed, as the plates 16 and 21 seat against and seal the apertures 51.

Preferably each plate 16 and 21 also is provided with a window track clamp which extends coextensively the length of the plates 16 and 21. As shown in FIG. 9, the window clamp has a flat web 22 that projects towards the window track 64 and has a channel 37 on its outer edge which is received about the inner flange of the track 64 when the grill apparatus is compressed in the window opening.

The invention has been described with reference to the illustrated and presently preferred embodiment. It is not intended that the invention be unduly limited by this disclosure of the preferred embodiment. Instead, it is intended that the invention be defined by the means, and their obvious equivalents, set forth in the following claims.

What is claimed is:

1. A security grill apparatus for removable installation in a window opening having opposite window frame members, said grill apparatus comprising;

a. a grill section comprising a plurality of spaced apart grill bars, with at least one transverse base bar located adjacent one end of said grill section, b. at least two, spaced-apart extension bars, each engaged with a respective one of said grill bars which is opposite said one end of said grill section in a telescoping joint, and c. extension clamping means located at each of said telescoping joints, each clamping means comprising a lug member secured to its respective extension bar, and a toggle lever assembly attached to one of said grill bars and comprising a lever arm, an adjustable support, a base plate having first and second ends, and a channel, with said lever arm having a first pivotal connection to said lug member, and with said base plate pivotally secured at its first end to said lever arm at a second pivotal connection located beneath and inward of said first pivotal connection, thereby providing a toggle joint, said base plate being slidably received in said channel, with said channel fixedly secured to said respective one of said grill bars and with the second end of said base plate resting on said adjustable support also located within said channel, and including means to advance and retract said adjustable support means whereby said first and second grill sections may be moved telescopically apart by movement of said lever arm, and the amount of said telescopic movement of said first and second grill sections may be varied by adjustment of said adjustable support means to exert compressive force on respectively opposite frame members of said window opening to make removal of said apparatus from said window difficult.

2. The apparatus of claim 1 including a pad of elastomeric material having an outer surface formed into a plurality of cup-shaped concave depressions and secured to the outer surface of said base bar by spaced-apart attachment means with said outer surface of said pad compressed against said window frame members.

3. The apparatus of claim 1 adapted for installation in a window opening having a window with parallel first and second window tracks having an inside track flange and receiving a sliding window in said tracks, with said apparatus including a window frame clamp coextensive with said base bar having an orthogonal flat flange projecting towards said window with a channel coextensive with the outer edge of said flat flange oriented to hook into the inside flange of said window track.

4. The apparatus of claim 1 wherein said grill section includes longitudinally elongated, straight, laterally spaced apart parallel bars.

5. The apparatus of claim 4 wherein said telescoping bars are longitudinally elongated, straight parallel hollow form bars longitudinally aligned with and telescopically received within respective bars of said grill section.

6. The apparatus of claim 5 wherein the base ends of said parallel bars of said grill section are coterminous.

7. The apparatus of claim 6 wherein said grill section distally supports an elongated base member having a flat outer edge.

8. The apparatus of claim 1 wherein said lever arm includes a U-shaped channel cover which is received over said base plate.

9. The apparatus of claim 8 including means for locking a lever mechanism of a toggle clamp to said base plate when said lever mechanism is pivoted inward towards said base plate to a closed position.

10. The apparatus of claim 9 wherein said locking means comprises a first hole through said base plate and a second hole through said lever arm which are in alignment when said clamp is in a closed position, whereby a locking pin may be inserted through said holes.

11. The apparatus of claim 9 wherein said locking means comprises in combination slots through an edge wall of said base plate and said lever mechanism which are in registered positions when said clamp is in a closed position, and a cylinder lock fastened to said clamp mechanism, said cylinder lock having a radially projecting lug adapted to engage both of said slots when said cylinder is rotated by means of a key inserted therein.

* * * * *